US007130554B2

(12) United States Patent
Takematsu

(10) Patent No.: US 7,130,554 B2
(45) Date of Patent: Oct. 31, 2006

(54) POWER SUPPLY FOR A FIRST AND SECOND HEATING ELEMENTS IN IMAGE FORMING APPARATUS WITH CONTROL BASED ON DETECTED TEMPERATURE AT START

(75) Inventor: Koji Takematsu, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 10/792,722

(22) Filed: Mar. 5, 2004

(65) Prior Publication Data

US 2004/0208665 A1 Oct. 21, 2004

(30) Foreign Application Priority Data

Mar. 6, 2003 (JP) ..... 2003-060010
Mar. 3, 2004 (JP) ..... 2004-058591

(51) Int. Cl.
*G03G 15/20* (2006.01)

(52) U.S. Cl. ..... 399/69

(58) Field of Classification Search ..... 399/69, 399/67, 70, 328, 329, 330
See application file for complete search history.

(56) References Cited

U.S. PATENT DOCUMENTS 6,047,158 A * 4/2000 Morigami et al. ..... 399/328
6,687,483 B1 * 2/2004 Chen et al. ..... 399/341
6,810,220 B1 * 10/2004 Hamada et al. ..... 399/69
6,889,018 B1 * 5/2005 Kinouchi et al. ..... 399/69
2003/0223791 A1 * 12/2003 Akita et al. ..... 399/328

FOREIGN PATENT DOCUMENTS

JP 61-124581 6/1987

OTHER PUBLICATIONS

Translation of JP04-21887a to Soma (or Souma).*

* cited by examiner

*Primary Examiner*—Quana Grainger
(74) *Attorney, Agent, or Firm*—Fitzpatrick, Cella, Harper & Scinto

(57) ABSTRACT

The present invention provides an image forming apparatus including, a heating member heating an image on a recording material having a first exothermic element in which the calorific value of the central portion is larger than that of the end and a second exothermic element in which the calorific value of the end is larger than that of the central portion, a temperature detecting member for detecting the temperature of the heating member, power supply controlling device for controlling the power supply to the first and second exothermic elements so that the temperature of the heating member becomes a target temperature, a first starting mode for stopping the power supply to the first exothermic element and starting temperature rise of the heating member when reaching a preset temperature to start temperature rise of the heating member up to a target temperature capable of forming an image, a second starting mode for starting temperature rise up to the target temperature by using the fist and second exothermic elements, and selecting device for selecting a starting mode in accordance with a detection temperature at start of the starting operation.

6 Claims, 9 Drawing Sheets

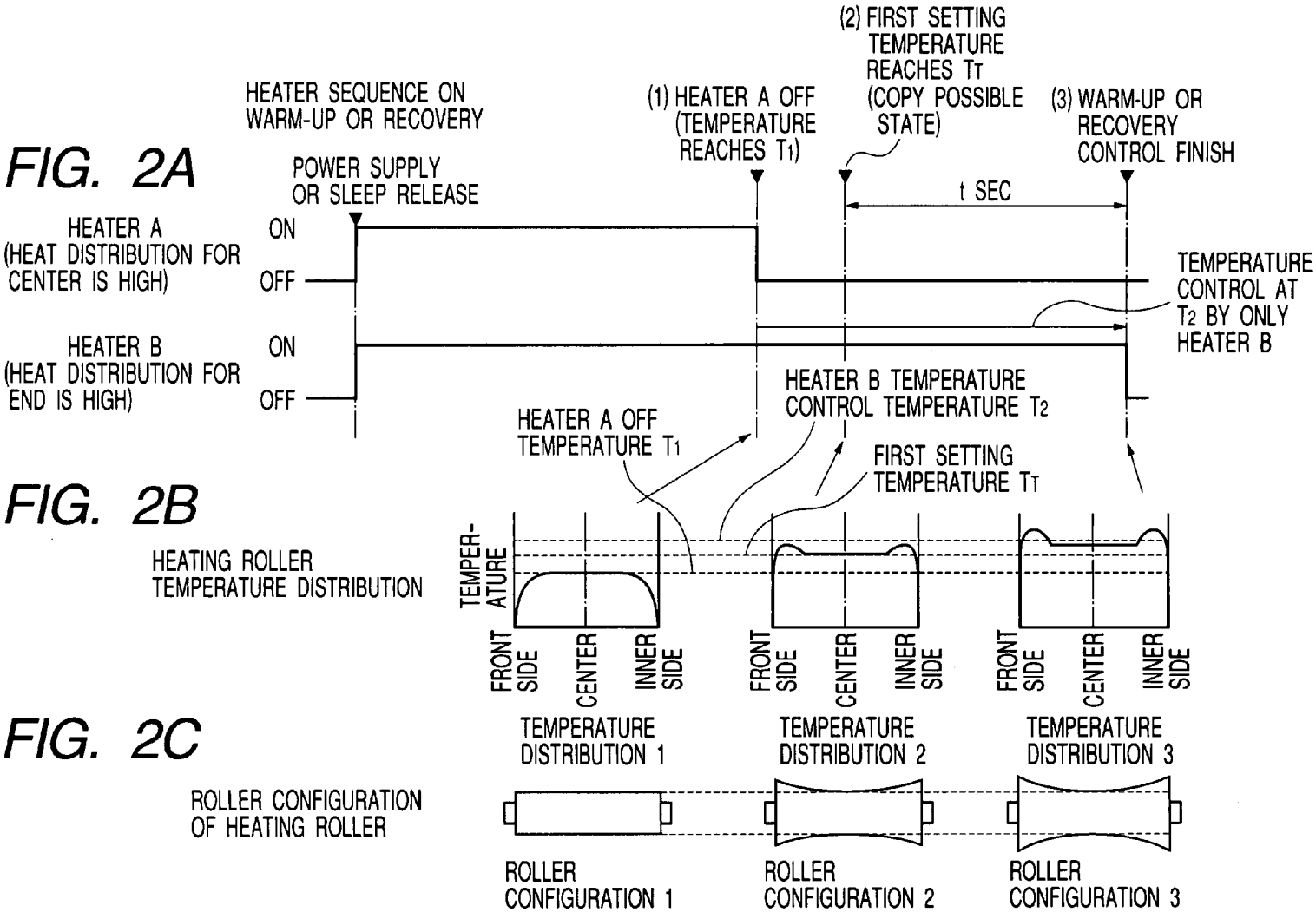
HEATER SEQUENCE ON WARM-UP OR RECOVERY
POWER SUPPLY OR SLEEP RELEASE
ON
OFF
ON
OFF
HEATER A (HEAT DISTRIBUTION FOR CENTER IS HIGH)
HEATER B (HEAT DISTRIBUTION FOR END IS HIGH)
(1) HEATER A OFF (TEMPERATURE REACHES T1)
(2) FIRST SETTING TEMPERATURE REACHES Tt (COPY POSSIBLE STATE)
t SEC
(3) WARM-UP OR RECOVERY CONTROL FINISH
TEMPERATURE CONTROL AT T2 BY ONLY HEATER B
HEATER B TEMPERATURE CONTROL TEMPERATURE T2
FIRST SETTING TEMPERATURE Tt
HEATER A OFF TEMPERATURE T1
FIG. 2A
TEMPERATURE
FRONT SIDE
CENTER
INNER SIDE
HEATING ROLLER TEMPERATURE DISTRIBUTION
FIG. 2B
TEMPERATURE DISTRIBUTION 1
TEMPERATURE DISTRIBUTION 2
TEMPERATURE DISTRIBUTION 3
ROLLER CONFIGURATION 1
ROLLER CONFIGURATION 2
ROLLER CONFIGURATION 3
ROLLER CONFIGURATION OF HEATING ROLLER
FIG. 2C

| FIG. 6A |
| --- |
| FIG. 6B |

POWER SUPPLY FOR A FIRST AND SECOND HEATING ELEMENTS IN IMAGE FORMING APPARATUS WITH CONTROL BASED ON DETECTED TEMPERATURE AT START

BACKGROUND OF THE INVENTION

1. Field of the Invention

An image forming apparatus using an electrophotographic system normally has a fixing apparatus for melting and fixing a transferring material and toner made of a resin, magnetic material and coloring material electrostatically carried by the transferring material by heating and pressuring the transferring material and toner while nipping and conveying them by heating means (roller and endless belt body) for pressure-contacting them each other and rotating them and the pressure-contacting portion (nipping portion) of pressuring means (roller and endless belt body).

2. Related Background Art

In general, a fixing apparatus is used to thermally fix a toner image formed on a recording material serving as a recording material to the recording material in accordance with an electrophotographic recording system.

A fixing apparatus has a heating roller provided with a heater for producing heat and a pressuring roller for forming a nipping portion for pressure-contacting with the heating roller and nipping and conveying a recording material and fixes a toner image on the recording material to the recording material with heat and pressure.

A recording material to which a toner image is transferred is guided by a guide and conveyed between a hearing roller and a pressuring roller and heated and pressured and thereby, the toner on the toner image is melted and fixed to the recording material and the recording-material toner image is fixed to the recording material.

Thus, conditions necessary for fixing are a roller temperature for melting a toner layer on a recording material, time for the toner layer to pass through a heating roller and pressuring roller and pressure between the heating roller and pressuring roller and the time for the recording material to pass through the heating roller and pressuring roller is decided by circumferential speeds of the heating roller and pressuring roller and the nipping width between the heating roller and pressuring roller.

Moreover, to prevent a temperature rise of a non-sheet passing portion which occurs when passing a small-size recording material, heaters A4 and B5 are used so that calorific value distributions of the heaters A4 and B5 in the longitudinal direction become two types different from each other as shown in FIG. 5 and peak positions of these calorific values due to these calorific value distributions are not approximately overlapped. That is, in the case of a small-size recording material with a small width when forming a normal image, temperature control is performed by decreasing the turning-on rate of the heater B. Moreover, in the case of a recording material with a large width, temperature control is performed by successively turning on the both heaters in time shearing. In FIG. 5, the output of the heaters A4 is approx. 800 W and that of the heater B5 ranges from about 400 to 600 W. These values are decided so that they do not exceed the allowable power of an image forming apparatus even if the heaters A4 and B5 are simultaneously turned on under warm-up and a small-size recording material can be sufficiently fixed by only the heater A4.

In the case of a color-image forming apparatus for forming a color image by mixing a plurality of color toners, it is impossible to obtain a clear color image because an unfixed toner image expands at a nipping portion when a heating roller contacting with a toner image on a recording material has a high hardness. Therefore, by forming an elastic layer on the core bar of the heating roller and preventing the toner image from expanding by the elastic layer, it is possible to obtain a clear color image.

In the case of the starting operation of the fixing apparatus having the above configuration, it is possible to start rise of the temperature of the heating roller up to a preset start-completion temperature in a short time by fully turning on the heaters A and B with the maximum power respectively.

However, when heating a heating roller having an elastic layer, the following problem occurs. Overshoot occurs in which heat inside a heating roller is transmitted to the surface of the roller later even if a heater is turned off after the surface temperature reaches a target temperature because the heat conductivity of the elastic layer is low and time is required unit heat reaches the surface via the elastic layer after the heat is supplied to the core bar. Therefore, to decrease the overshoot, there is a method for decreasing a calorific value. In this case, however, the start time increases.

Therefore, as described in Japanese Patent Application Laid-Open NO. H62-124581, to prevent overshoot without extremely increasing the start time, there is a method for uniformly keeping a temperature distribution by forcibly turning off a main heater when the surface temperature of a heating roller reaches a predetermined temperature, operating only a subheater and causing overshoot at the central portion while only the subheater is operated.

However, an overshoot mount greatly depends on a calorific value supplied to the heating roller. That is, when turn-on time of a heater increases, the calorific value accumulated in the heating roller also increases and the overshoot amount also increases. When turn-on time of a heater decreases, the overheat decreases. Therefore, when the temperature of the heating roller is high like the case of the recovery operation after jam processing, the time for the surface temperature of the heating roller to reach a target temperature is short. Therefore, the overshoot amount decreases even if continuously turning on the main heater. Therefore, by forcibly turning off the main heater when reaching the above predetermined without variation independently of the surface temperature of the heating roller, a problem occurs that time is required for recovery because the starting operation is performed by only the subheater though the overshoot amount is small even if turning on the main heater.

SUMMARY OF THE INVENTION

It is an object of the present invention to start temperature rise up to a level at which an image can be formed in a short time. It is another object of the present invention to decrease an overshoot amount after starting operation is completed.

It is still anther object of the present invention to provide an image heating apparatus comprising:

a heating member which has a first exothermic element in which the calorific value of the central portion is larger than that of the end and a second exothermic element in which the calorific value of the end is larger than that of the central portion and heats an image on a recording material;

a temperature detecting member for detecting the temperature of the heating member;

power-supply controlling means for controlling the power supply (or current) to the first and second exothermic elements so that the temperature of the heating member reaches a target temperature;

a first starting mode for stopping the power supply to the first exothermic element and restarting power supply when the temperature of the heating member reaches a preset temperature while starting rise of the temperature of the heating member up to a target temperature at which an image can be formed;

a second starting mode for staring temperature rise up to the target temperature by using the first and second exothermic elements; and selecting means for selecting a starting mode in accordance with the detection temperature when starting the starting operation.

BRIEF DESCRIPTION OF THE DRAWINGS

FIGS. 2A, 2B and 2C are illustrations showing a heater sequence, heating-roller temperature distribution and heating-roller shape;

DESCRIPTION OF THE PREFERRED EMBODIMENTS

A preferred embodiment of the present invention is illustratively described below in detail by referring to the accompanying drawings. However, the range of the present invention is not restricted to dimensions, materials, shapes of components and relative arrangement of the components described for this embodiment unless otherwise specified.

Figure 1:
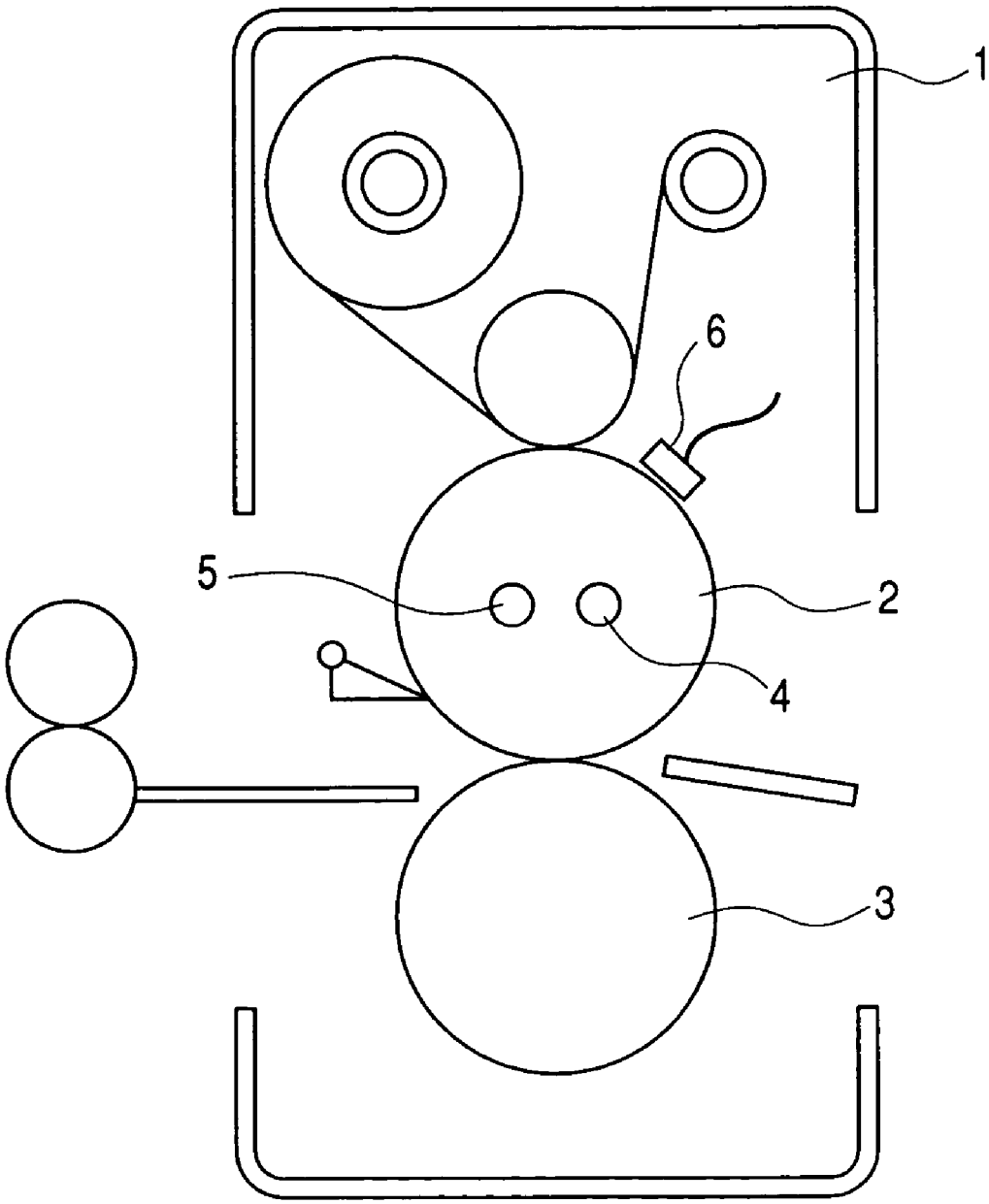
FIG. 1 is a sectional view showing a fixing apparatus of an embodiment.

FIG. 1 is a sectional view showing a sectional configuration of a fixing apparatus 1 of an embodiment. In FIG. 1, the fixing apparatus 1 has a heating roller 2 serving as a heating member and a pressure roller 3 serving as a pressuring member for pressure-contacting with the heating roller 2. The fixing apparatus 1 fixes a toner image on a sheet by passing (that is, nipping and conveying) a recording material serving as a recording material holding (nipping) the toner image at a portion (that is, a nipping portion) between the heating roller 2 and the pressuring roller 3 while heating the surface of the heating roller 2 at a predetermined temperature by two heaters (heaters A4 and B5) serving as a plurality of exothermic elements in the heating roller 2 and thereby heating and pressuring the toner image side (upside) of the recording material and melting and fixing toner.

The heating roller 2 is a hollow cylinder, uses a hollow metallic core bar having a wall thickness of 3.0 mm or less and has a mold releasing resin layer such as PTFE on the surface. Moreover, the heaters A4 and B5 are set in the metallic core bar. Furthermore, a thermistor 6 serving as a temperature detector contacts with the vicinity of the axial-directional central portion of the surface of the heating roller 2 to measure the surface temperature of the heating roller 2.

Figure 5:
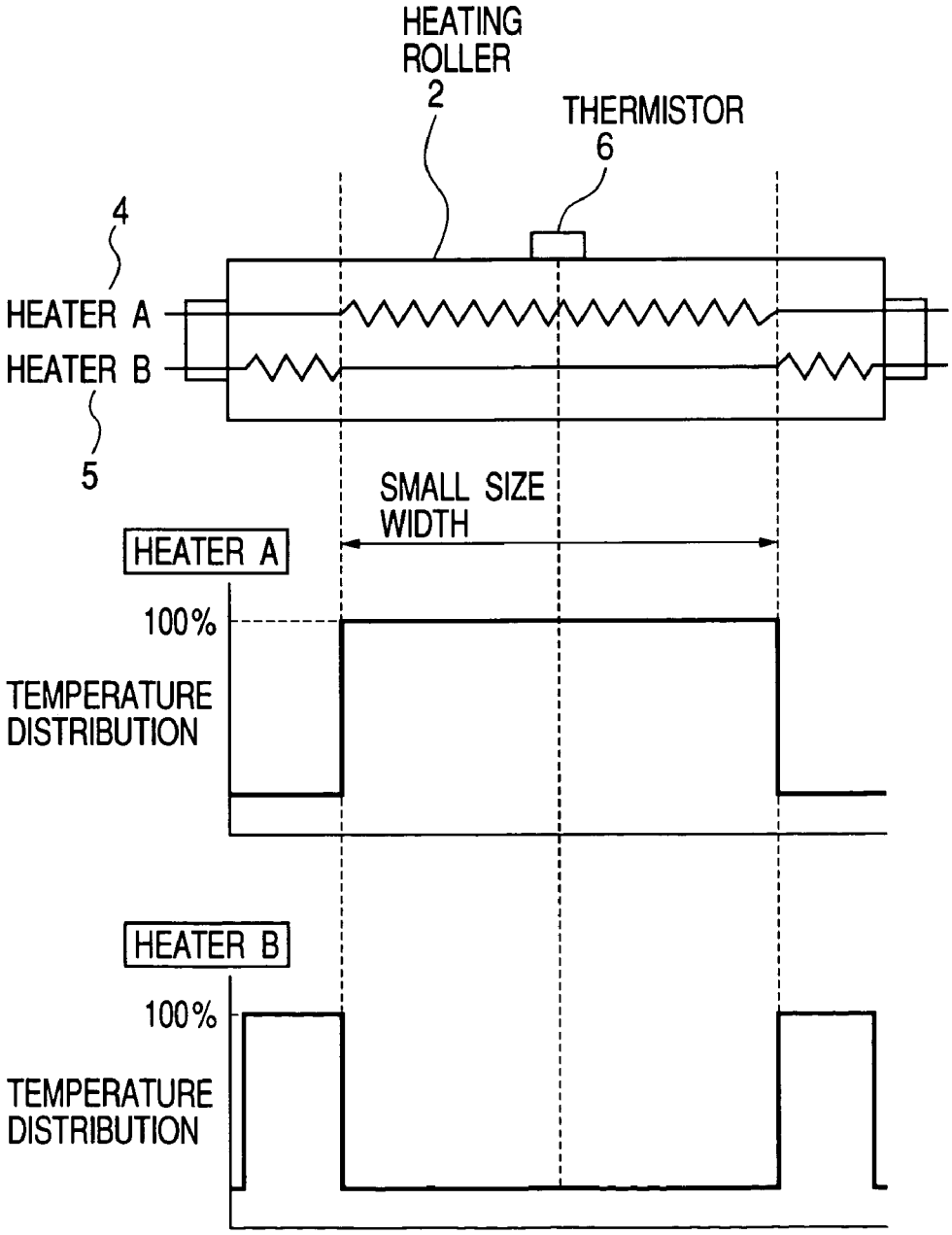
FIG. 5 is an illustration for explaining a schematic configuration and calorific value distribution of a heater set in a heating roller.

Calorific value distributions (hereafter respectively referred to as, heat-allotment distribution) in axial directions of the heater A4 serving as the first exothermic element and the heater B4 serving as the second exothermic element in their axial directions use the conventional distribution shown in FIG. 5. This embodiment uses a halogen heater.

That is, the heater 4A has the peak position of calorific values (hereafter referred to as heat allotment peak) at a portion corresponding to a small-size recording material whose size is 60 to 85% of the maximum width. Hereafter, the heat allotment distribution of the heater A4 is referred to as central heat allotment high. The heater B has a heat allotment peak other than the heat allotment peak of the heater A4 at the both ends in the axial direction. Hereafter, the heat allotment peak of the heater B5 is referred to as end heat allotment high. The heat allotment peaks of the heaters A4 and B5 are constituted so that they are not approximately overlapped. The heaters A4 and B5 are controlled by power supply controlling means (or current controlling means) for controlling the power supply (or current) to each heater.

Moreover, the heaters A4 and B5 are made to simultaneously produce heat at the time of warm-up and recovery from sleep mode.

Furthermore, when forming an image on a small-size recording material with a small width while forming a normal image, temperature rise at the axial-directional end of the heating roller 2 is prevented by using only the heater 4A and thereby controlling temperature.

However, when forming an image on a recording material with a large width while forming a normal image, the both heaters A4 and B5 are used to perform control by making them successively produce heat.

Heater outputs of this embodiment are the same as ever and the output of the heater A4 is 800 W and that of the heater B5 is 400 W.

FIG. 2 shows heater sequences under warm-up, recovery from sleep mode and change from standby state to image formation (generally referred to as period up to image formation ready state) and temperature distribution and shape of the heating roller 2 in the period.

In the case of this embodiment, four set temperatures are used under warm-up, sleep mode and recovery from standby state.

Fixing temperatures at which copying can be started are a first set temperature TT, second set temperature T1, third set temperature T2 and fourth set temperature T3 and these temperatures have a relation of T3<T1<TT<T2. For example, in the case of this embodiment, the first set temperature TT is set to 190° C., second set temperature TT1 is set to 185° C., third set temperature T2 is set to 195° C. and fourth set temperature T3 is set to 195° C. In the case of this embodiment, the temperature-control temperature under fixing is controlled at 190° C. and at 190° C. under the standby state.

In the case of this embodiment, heater sequences are changed under power-on and recovery from sleep mode and when the temperature of the heating roller 2 is sufficiently lowered {for example, early morning (hereafter referred to as morning first) when an apparatus is sufficiently cooled} and when the temperature of the heating roller 2 is slightly high such as in the case after jam processing or at the time when power is turned on immediately after power is turned off. The change of heater sequences is separately performed depending on the fact that the temperature of the heating roller 2 is higher or lower than the fourth set temperature T3.

First, when the temperature of the heating roller 2 measured by the thermistor 6 is lower than the fourth set temperature T3 such as the time of power-on or recovery from sleep mode, the following heater sequence is used.

As shown in FIG. 2A, both the heaters A4 and B5 are turned on. Thereafter, when the temperature of the heating roller 2 reaches the second set temperature T1, the central-heat-allotment-high heater A4 is forcibly turned off by a power-supply stopping portion serving as power-supply stopping means and immediately after that, temperature control is started so as to keep the third set temperature T2 by only the end-heat-allotment-high heater B5.

In this case, because there is the relation of T1<TT<T2, the temperature of the heating roller 2 is raised up to the third set temperature T2 while the heater B5 is turned on after reaching the second set temperature T1. While the temperature of the heating roller 2 is raised, pieces of information on copied and printed images can be started anytime after reaching the first set temperature TT at which copying can be started.

The temperature distribution of the heating roller 2 in the above case is changed with time as shown in FIG. 2B.

That is, when reaching the second set temperature T1, the temperature of the heating roller 2 is uniform at front and back or kept in an end-temperature flagging state as shown by the temperature distribution 1.

When reaching the first set temperature TT, the temperature of the heating roller 2 at the axial-directional end is relatively higher than the temperature of the axial-directional central portion of the heating roller 2 due to end heat allotment high of the heater B5 as shown by the temperature distribution 2.

In the case of the shape of the heating roller 2 when reaching the first set temperature TT, the core bar of the axial-directional end of the heating roller 2 is thermally expanded, diameters of the both ends of the heating roller 2 are increased and a reverse-crown shape is resultantly properly formed as shown by the roller shape 2 in FIG. 2C.

Because the reverse-crown increase value due to the thermal expansion can be fine-adjusted compared to the case of forming a reverse crown according to working depending on the temperature difference between the axial-directional end and axial-directional central portion, it is possible to form an optimum reverse-crown shape which can be applied only when the two heaters A4 and B5 are simultaneously turned on such as at the time of warm-up. In the case of this embodiment, by setting the temperature difference between the axial-directional end and axial-directional central portion to approx. 10° C., it is possible to form a crown value of approx. 50 μm.

When forming a reverse-crown shape according to working only for preventing fixing creases when turning on the heaters A4 and B5 at the same time under warm-up without using the heater sequence of this embodiment, it is necessary to form an excessively large reverse-crown shape from the beginning by considering decrease of a reverse-crown value under warm-up and it is considered that a crown value for preventing rear-end bounce and end wavy crease due to increase of a reverse-crown value and fixing crease which is a trouble due to decrease of the reverse-crown value runs short.

Therefore, by using the heater sequence of this embodiment, it is possible to form an optimum reverse crown shape without increasing a heating-roller reverse-crown value due to working and prevent fixing crease without a trouble such as rear-end bounce when two heaters A4 and A5 at the time of warm-up, recovery and the like are turned on at the same time.

Temperature control is performed in accordance with the third set temperature T2 by only the heater B5 until a predetermined time t elapses after reaching the first set temperature TT. In the case of the above control, the heater B5 is continuously turned on until reaching the third set temperature T2 and the temperature rise speed at the axial-directional central portion of the heating roller 2 becomes moderate compared to the case in which the heater A4 is turned on because the heater B5 is end temperature allotment high.

Thereby, before reaching the third set temperature T2, the end temperature of the heating roller 2 is kept higher than the central-portion temperature. Therefore, it is possible to keep a reverse crown shape like the roller shape 3 in FIG. 2C.

Similarly, also after the surface temperature of the heating roller 2 reaches the third set temperature T2, only on/off control of the heater B5 is performed and temperature is controlled by the end-heat-allotment-high heater B5. Therefore, the end temperature of the heating roller 2 is kept higher than the central-portion temperature and it is possible to keep the reverse-crown shape.

Therefore, until the predetermined time t elapses after reaching the first set temperature TT at which copying can be started, it is possible to always use the reverse-crown shape as the shape of the heating roller 2 and restrain the fixing crease due to disappearance of a crown shape at the time of morning-first warm-up or recovery from sleep mode or formation of a normal crown. In this case, a predetermined time t1 ranges between 3 and 5 min in the case of this embodiment.

Moreover, by using the heater sequence of this embodiment, it is possible to turn on the central heat-allotment-high heater A4 for a comparatively long time without thinning it as ever under warm-up and recovery. Therefore, it is possible to greatly decrease warm-up time and recovery time while keeping the shape of the heating roller 2 at a reverse-crown shape.

Furthermore, when the surface temperature of the heating roller 2 for the starting operation to start is low, a calorific value supplied to the heating roller extremely increases because the time for heating the heating roller is long before reaching the start completion temperature. Therefore, even if turning off the main heater, it is possible to decrease the overshoot amount even after the starting operation is completed by using the above sequence and resultantly, uniform the temperature irregularity in the longitudinal direction of the heating roller because the overshoot amount when internal heat appears on the outside later increases.

Then, the temperature of the heating roller 2 is higher than the fourth set temperature T3 such as the case after jam processing or the case in which a power supply is turned on immediately after turning it off, the following sequence is used.

The both heaters A4 and B5 are turned on. Thereafter, when the temperature of the heating roller 2 reaches the first set temperature TT, a state ready to start copying or printing anytime is set. A sequence after the state ready to start copying is the same as the heater sequence when the temperature of the heating roller 2 is lower than the fourth set temperature T3 as described above. That is, even if reaching the temperature T1 for forcibly turning on the main heater, by continuing the power supply to the main heater the temperature for forcibly turning off the main heater is changed to the temperature TT higher than T1 by temperature changing means.

The above sequence is executed because a trouble occurs that the warm-up time is delayed by starting the above heater sequence when the temperature of the heating roller 2 is lower than the fourth set temperature T3 with a state in which the heating roller 2 is slightly hot.

That is, even if turning on the heaters A4 and B5 at the same time in a state in which the heating roller 2 is slightly hot, the temperature immediately reaches the second set temperature T1. Therefore, the main heater is turned only for a short time and the overshoot mount is small. Moreover, even if a state ready to form an image is set, the starting operation is continued by only the heater B. Therefore, it is possible to prevent the temperature irregularity of the heating roller due to overshoot.

Furthermore, when the heating roller 2 is slightly hot, the temperature of the heating roller 2 immediately reaches the first set temperature TT and thereafter, temperature control is performed by the heater B5. Therefore, end temperature flagging of the heating roller 2 due to radiation or the like does not easily occur or the reverse crown amount of the heating roller 2 does not decrease. Therefore, it is possible to sufficiently restrain fixing creases.

Heater sequences used for warm-up, recovery from sleep mode and change from standby state to image formation are described below by referring to the flowchart in FIG. 3.

Figure 3:
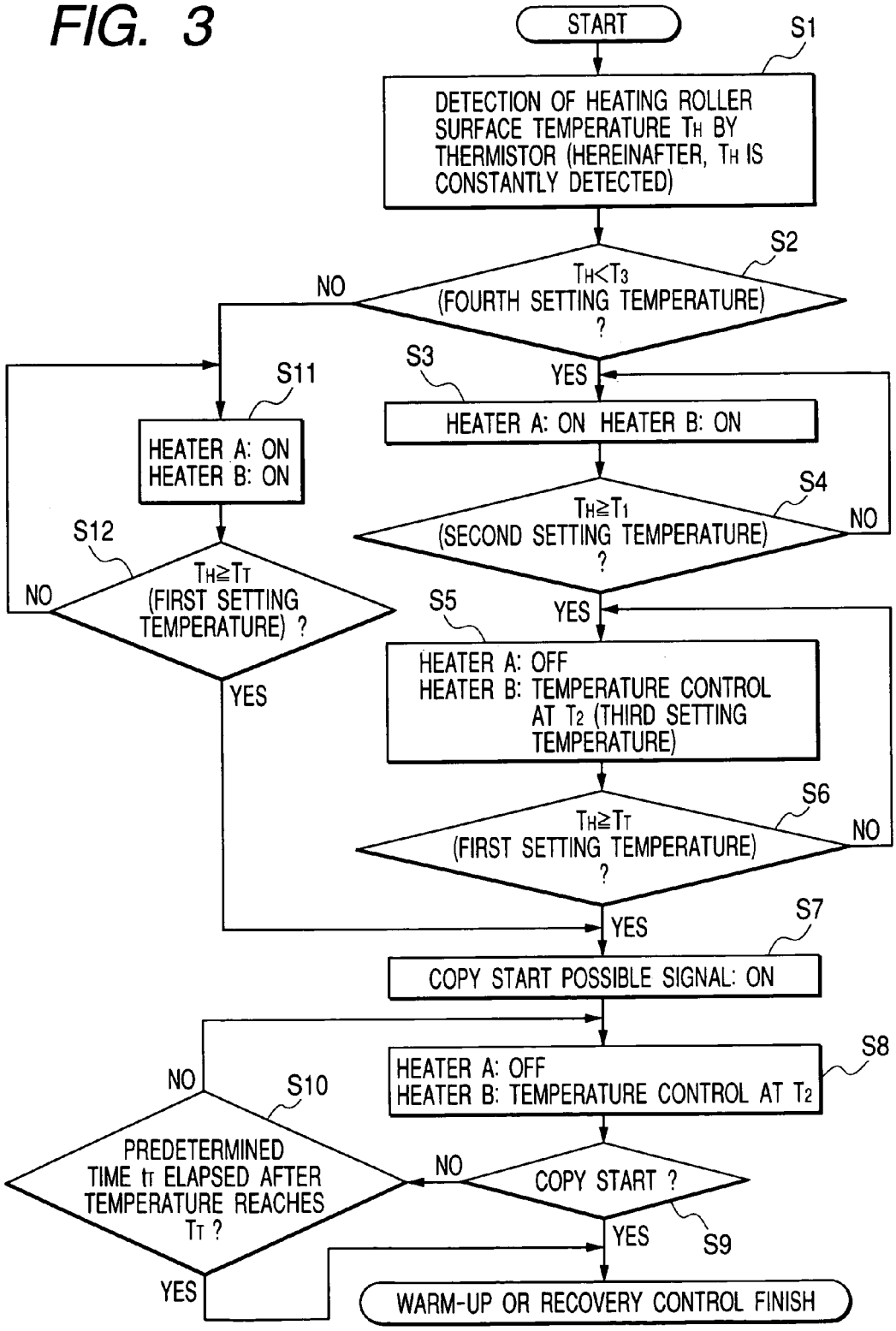
FIG. 3 is a flowchart for explaining a heater sequence of a first embodiment.

In FIG. 3, the detection temperature TH at start of the starting operation is assumed as the surface temperature of the heating roller 2 detected by the thermistor 6.

First, the detection temperature TH of the heating roller 2 is detected by the thermistor 6 in S11 and S12 is started.

It is checked in S12 whether the detection temperature TH is lower than the fourth set temperature T3 and it is determined whether the temperature of the heating roller 2 at the time of start is high. When the detection temperature TH is lower than the fourth set temperature T3 in S12, S13 is started which is a first starting mode to turn on the both heaters A4 and B5 and heat the heating roller 2 and start S14. When the detection temperature TH is not lower than the fourth set temperature T3 in S12, S111 which is a second starting mode is started. S111 and S112 will be described later.

It is checked in S14 whether the temperature of the heating roller 2 reaches the second set temperature T1. When the temperature of the heating roller 2 does not reach the second set temperature T1, S13 is restarted to turn on the both heaters A4 and B5 and heat the heating roller 2. When the temperature of the heating roller 2 reaches the second set temperature T1, S15 is started to turn off the heater A4 and perform temperature control so as to keep the temperature of the heating roller 2 at the third set temperature T2 by only the heater B5 and S16 is started.

It is checked in S16 whether the detection temperature TH is equal to or higher than the first set temperature TT to determine whether the temperature of the heating roller 2 reaches the first set temperature TT. When the temperature of the heating roller 2 reaches the first set temperature TT, S17 is started to turn on a copying-ready signal, then S18 is started to perform temperature control at the third set temperature T2 by only the heater B5 and start S19. When the temperature of the heating roller 2 does not reach the first set temperature TT, S15 is restarted to progress temperature control at the third set temperature T2 by the heater B5.

It is checked in S19 whether a copy start signal is input. When the signal is input, the heater sequence of this embodiment is completed. When the signal is not input, S110 is started to check whether the predetermined time t1 elapses after the first set temperature TT. When the time t1 does not elapse yet, S18 is restarted to perform temperature control at the third set temperature T2 by the heater B5. When the time t1 elapses, the heater sequence of this embodiment is completed.

In the above description, S11 to be started when the detection temperature TH is not lower than the fourth set temperature T3 in S12 denotes a heater sequence when the temperature of the heating roller 2 at start is comparatively high. When the detection temperature TH is not lower than the fourth set temperature T3 in S12, S111 is started to turn on the both heaters A4 and B5 and start S112.

When the temperature of the heating roller 2 reaches the first set temperature TT in S112, S17 is started to turn on the copying start signal and start S18. When the temperature of the heating roller 2 does not reach the first set temperature TT in S112, S111 is restarted to turn on the both heaters A4 and B5.

Even when the detection temperature TH is not lower than the fourth set temperature T3, steps from S17 downward are the same as the heater sequence when the temperature of the heating roller 2 at start is comparatively low.

(Outline of Image Forming Apparatus)

Figure 4:
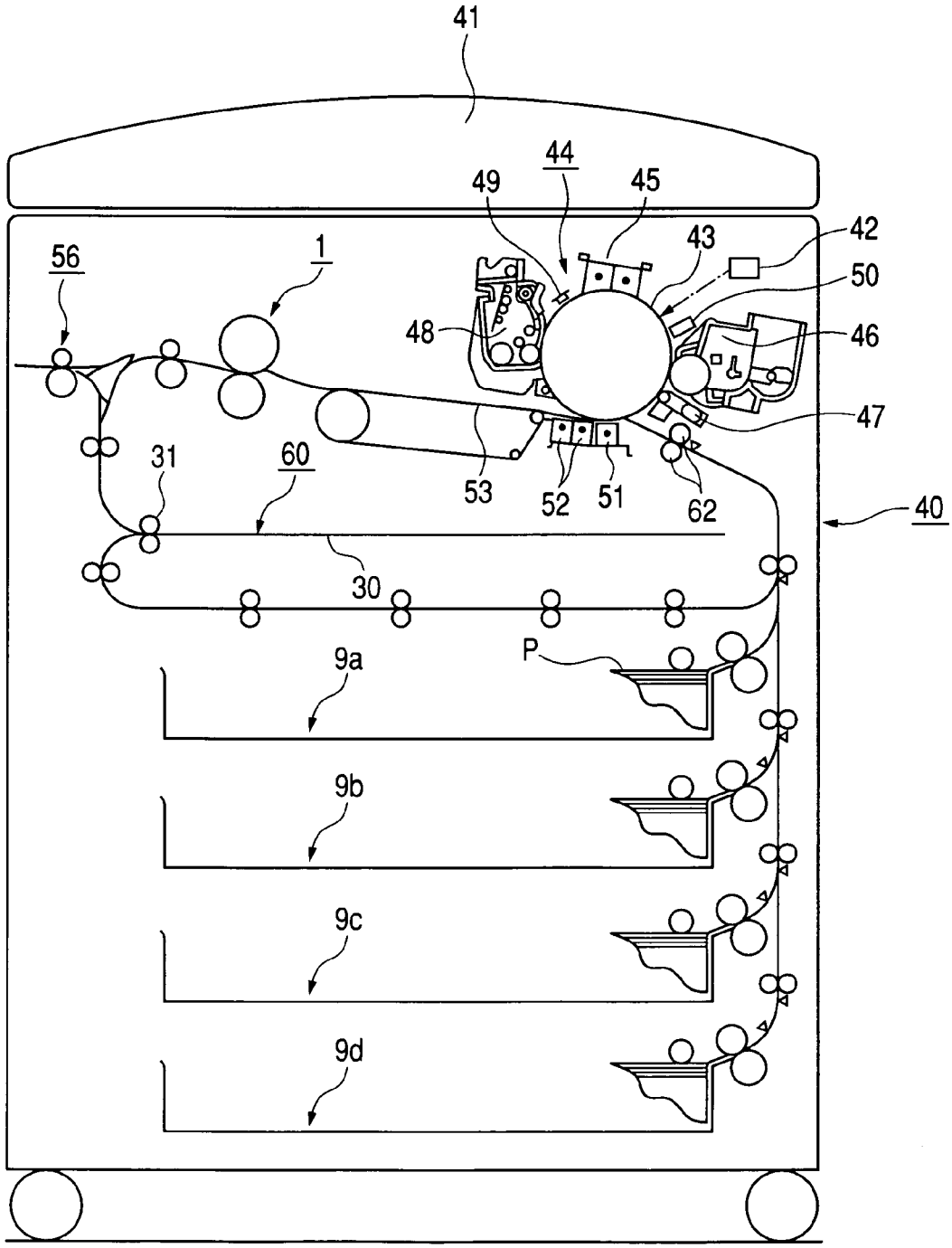
FIG. 4 is a sectional view showing an image forming apparatus to which a fixing apparatus of an embodiment is applied.

The general configuration and operations of an image forming apparatus using the fixing apparatus 1 of this embodiment are described below by referring to FIG. 4. FIG. 4 shows a sectional view of a schematic configuration of an image forming apparatus.

An automatic original reading portion 41 is located at the upside of an image-forming-apparatus body 40. The automatic original reading portion 41 reverses the both sides of an original, automatically feeds the original onto platen glass, reads the image information on the original on the platen glass by a light-receiving device such as a CCD and outputs the image information as image signals.

Then, an image signal output from the automatic original reading portion 41 is converted into a recording signal suitable for laser recording and processed by a not-illustrated image processing portion.

A laser-beam optical system 42 emits light in accordance with a recording signal and performs optical scanning on a rotating photosensitive drum 43 to form a latent image on the photosensitive drum 43 electrified by a primary electrifier 45.

In this case, an image forming portion 44 is constituted by the primary electrifier 45 provided on the photosensitive drum 43 and its periphery, a surface electrometer 50, a developing device 46, a post electrifier 47, a transfer electrifier 51, a separation electrifier 52, a cleaner 48 and a pre-exposure lamp 49.

The image forming portion 44 develops a latent image on the photosensitive drum 43 to form a toner image. Then, the toner image is transferred onto a recording material P fed from the photosensitive drum 43 synchronously with any one of sheet feeding portions 9*a* to 9*d*. Thereby, the toner image is beared by the recording material P.

In a one-side image forming mode, the recording material P bering the transferred toner image is conveyed by a conveying belt 53 and fixed by the fixing apparatus 1 and then, discharged from a sheet discharging portion 56.

The sheet discharging portion 56 is provided with a finisher making it possible to finish a staple or the like though not illustrated and staple processing is executed every a discharged plurality of recording materials P.

In a both-side image forming mode, the one-side-image-formed recording material P completing image fixing to one side of the recording material P by the fixing apparatus 1 is conveyed to a reverse conveying portion 60 and reversed by a reversing portion 31 and thereafter, resent to the image forming portion 44 after passing through a reverse conveying route for conveying the reversed recording material P and a toner image T is transferred t the back of the recording material P.

The reverse conveying portion 60 is a reverse conveying portion according to the "non-stack conveying system" for immediately conveying one-side-image-formed recording materials P to the image forming portion 44 without using a stack differently from a system for piling up one-side-image-formed recording materials P in a stack and then discharging them. This type of non-stack-system reverse conveying portion has an advantage of removing a loss from a stack portion.

Moreover, the stack-system reverse conveying portion piles up the recording materials P in a stack to perform primary mounting. Therefore, a state in which the recording material P is not nipped by any rollers occurs and jamming and double feeding very frequently occur at the mounting portion of a stack or the like due to curling which occurs in the one-side-image-formed recording material P immediately after fixed without fail. However, because the recording material P is always nipped by rollers in the non-stack-system reverse conveying portion, factors of deterioration of the feeding reliability of the stack system are greatly decreased.

The image forming apparatus 40 uses a method of alternately forming an image on the first side and second side of the recording material P to improve the productivity of the non-stack-system double-side-image forming.

Therefore, according to the present invention, it is possible to start a main heater in a short time while preventing overshoot when the temperature of a fixing rotational body is high by using a configuration of forcibly stopping the power supply to a main heater in the middle of the starting operation.

(Second Embodiment)

Figures 6, 6A:
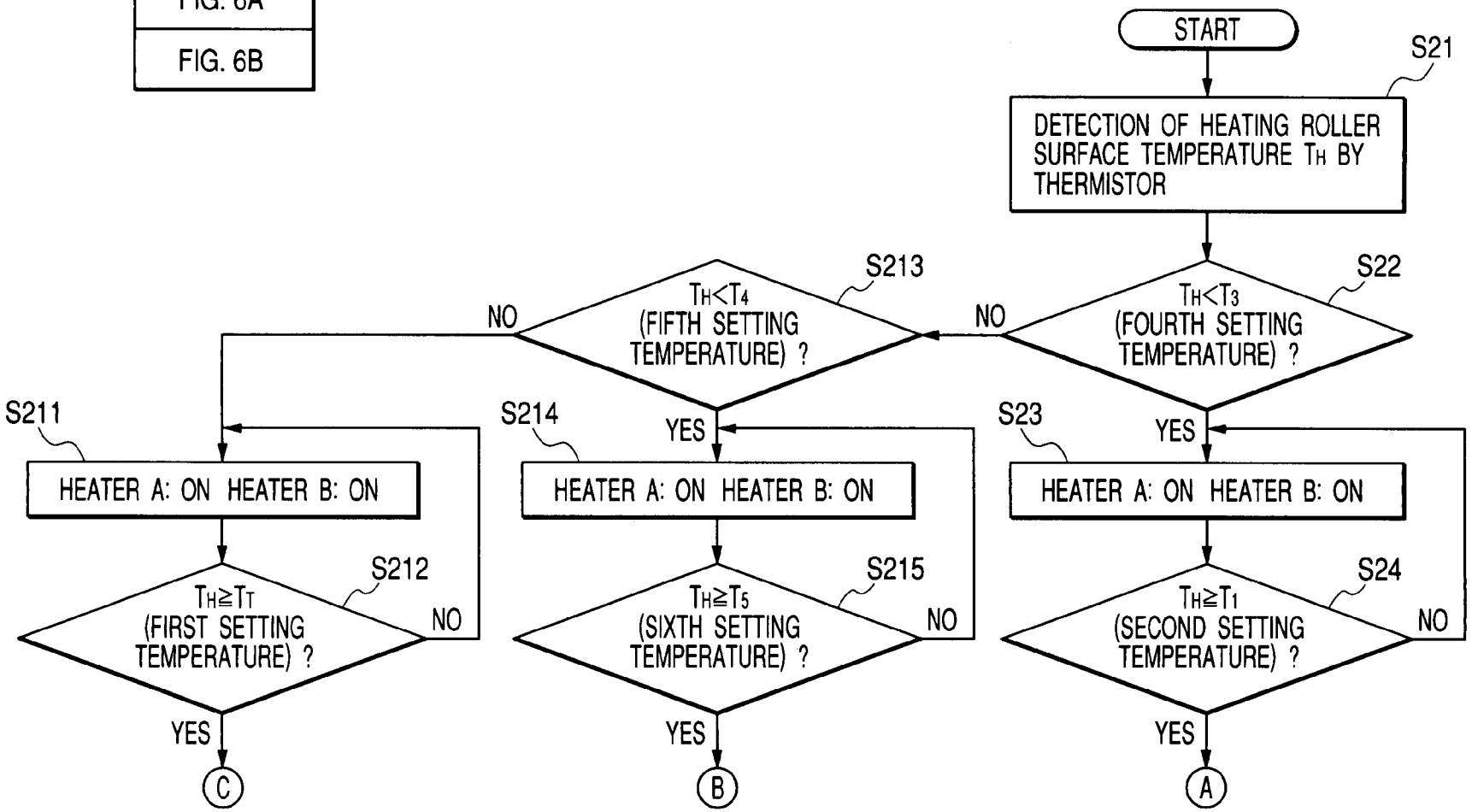
FIG. 6 is comprised of FIGS. 6A and 6B are flowcharts for explaining a heater sequence of a second embodiment.
Figure 6B:
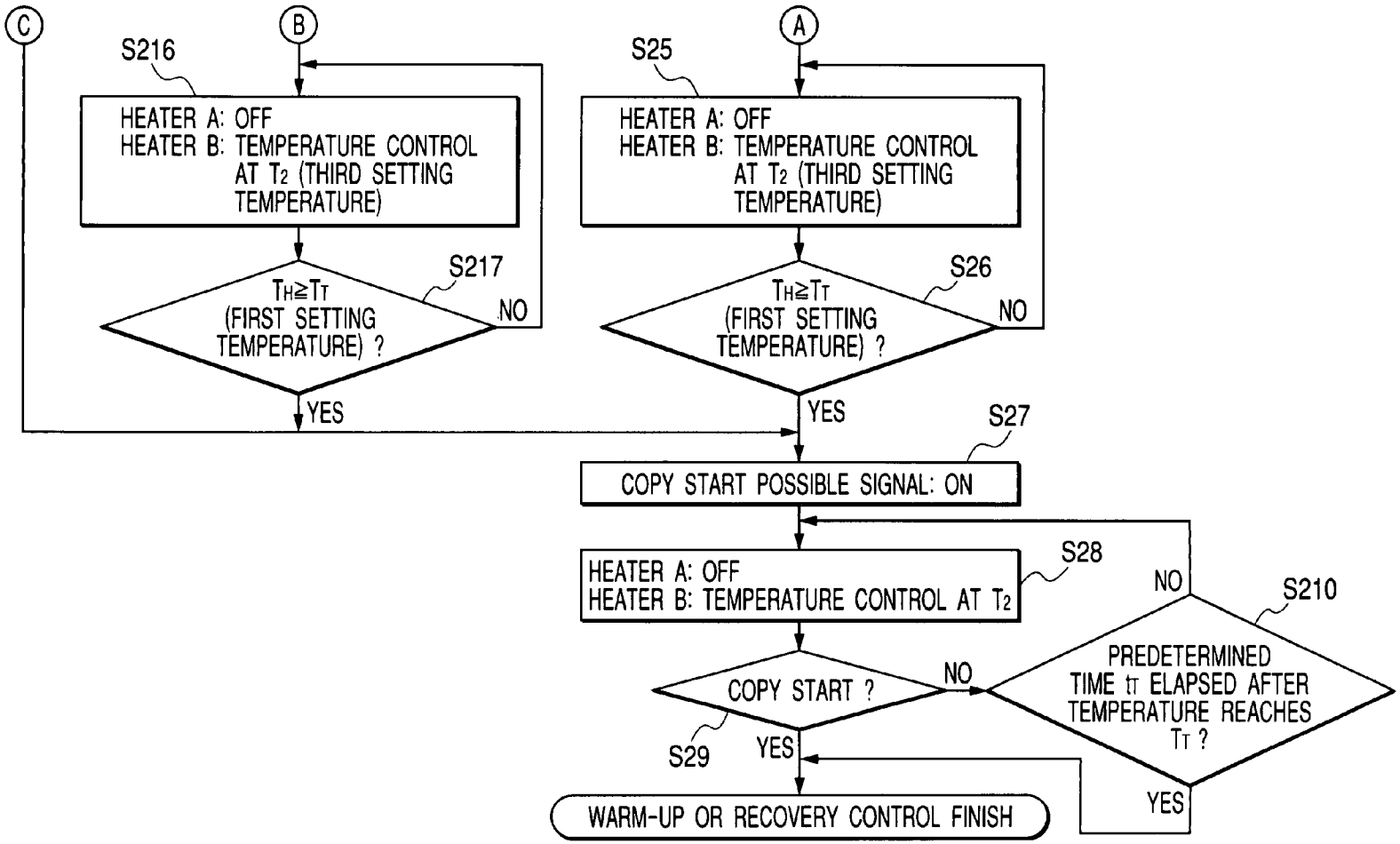

Another embodiment is described below by referring to FIG. 6. The configuration of the fixing apparatus of this embodiment is the same as that of the first embodiment.

In the case of set temperatures in this embodiment, the first set temperature TT is set to 190° C., second set temperature T1 is set to 180° C., third set temperature T2 is set to 195° C., fourth set temperature T3 is set to 100° C., fifth set temperature T4 is set to 170° C. and sixth set temperature T5 is set to 185° C. An image-forming-ready temperature is set to 190° C. and temperature control is performed at a temperature of 190° C. under the fixing operation. Moreover, temperature control is performed at a temperature of 190° C. under the standby state.

In FIG. 3, the detection temperature TH at start of the starting operation is assumed as the surface temperature of the heating roller 2 detected by the thermistor 6.

First, the detection temperature TH of the heating roller 2 is detected by the thermistor 6 in S21 to start S22.

In S22, it is checked whether the detection temperature is lower than the fourth set temperature T3 to determine whether the temperature of the heating roller 2 at start is high. When the detection temperature TH is lower than the fourth set temperature T3 in S22, S23 in the first starting mode is started to turn on the both heaters A4 and B5, heat the heating roller 2 and start S24. When the detection temperature TH is not lower than the fourth set temperature T3 in S24, S23 is started to continue the power supply to the heaters A and B until the detection temperature TH becomes lower than the fourth set temperature T3. Moreover, when the condition is satisfied, S25 is started to forcibly turn off the heater A. Moreover, S25 is continued until the condition in S26 is satisfied. When the detection temperature becomes T1, the present state is changed to the image-forming-ready state. The flow of S27, S28, S29 and S210 is the same as the flow of S17, S18, S19 and S110 of the first embodiment. However, in the case of this embodiment, a predetermined time t2 after reaching T1 is a time such as 1 min which is shorter than t1.

In S22, it is checked whether the temperature of the heating roller 2 reaches the fourth set temperature T3. When the temperature of the heating roller 2 reaches the fourth set temperature T3, S213 is started to compare the detection temperature with T4 which is lower than T3. When the detection temperature TH is higher than T4, S211 in the second starting mode is started. When the detection temperature TH becomes higher than TT in S212, S27 is started. Moreover, when the detection temperature TH is lower than T4 in S213, it is determined that the heating roller is slightly warm.

That is, when the power supply to the heaters A and B is continued up to S27 under the above state, an overshoot amount increases to uniform the temperature of the heating roller. Therefore, a predetermined time after reaching TT must be increased. However, by further increasing the number of stages like the case of this embodiment, it is possible to uniform the temperature of the heating roller even if setting the predetermined time to a small value.

In the case of this embodiment, a third starting mode is further set. In the case of this mode, a set temperature for forcibly turning off the heater A is higher than the set temperature of the first starting mode. Therefore, by newly setting T5 in S215, forcibly turning off the main heater in S216 when reaching T5 and performing temperature control by only the heater B, overshoot is made to occur during the above period and it is possible to uniform the temperature of the heating roller even if decreasing a predetermined time after reaching TT.

According to the present invention, it is possible to further decrease the time up to completion of start while preventing overshoot when the temperature of a fixing rotational body is high by using a configuration for forcibly stopping the power supply to the main heater in the middle of the starting operation.

(Third Embodiment)

Still another embodiment is described below by referring to FIG. 7. The configuration of the fixing apparatus of this embodiment is the same as the case of the first embodiment.

In the case of each of the first and second embodiments, the temperature for forcibly turning off the heater A serving as a main heater is changed in accordance with a detection temperature of a thermistor under the starting operation. In the case of the third embodiment, however, the temperature for forcibly turning off the heater A is changed by using a temperature rise ratio.

In this case, set temperatures used for this embodiment are described. Fixing temperatures in a copying-start-ready state are assumed as first set temperature TT, second set temperature T1, third set temperature T2 and fourth set temperature T3 and these temperatures T1 to T3 have a relation of T3<T1<TT<T2. In the case of this embodiment, for example, the first set temperature TT is set to 190° C., second set temperature T1 is set to 185° C., third set temperature T2 is set to 195° C. and fourth set temperature T3 is set to 170° C. In the case of this embodiment, the temperature-control temperature under fixing is controlled at 190° C. and controlled at 190° C. under the standby state.

Figure 7:
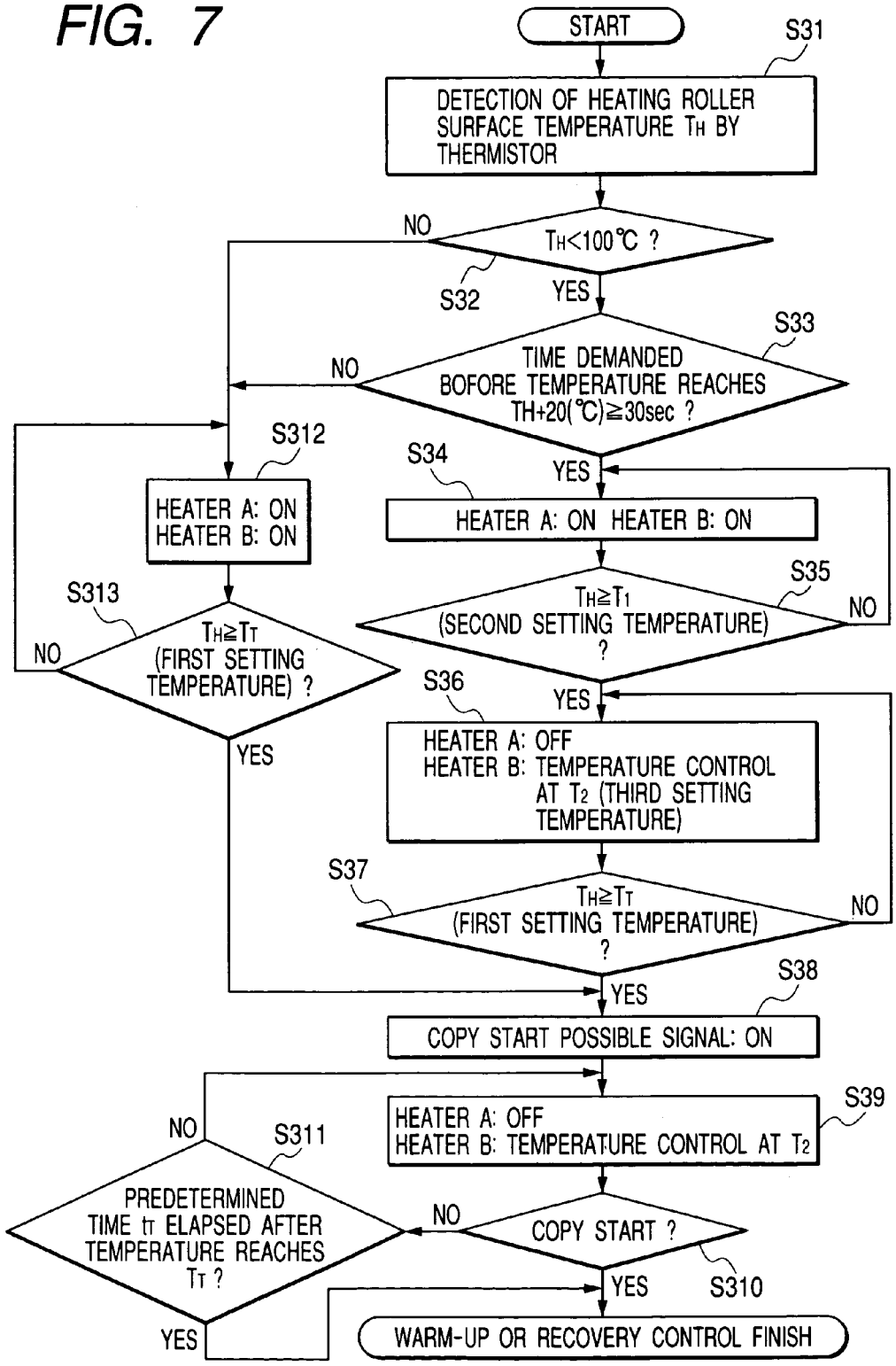
FIG. 7 is a flowchart for explaining a heater sequence of a third embodiment.

In FIG. 7, the detection temperature TH at start of the starting operation is assumed as the surface temperature of the heating roller 2 detected by the thermistor 6.

First, the detection temperature TH of the heating roller 2 is detected by the thermistor 6 in S31 to start S32.

In S32, it is checked whether the detection temperature TH is lower than 100° C. to determine whether the temperature of the heating roller 2 at start is high. When the temperature of the heating roller is higher than 100° C., S312 in the second starting mode is started to continuously turn on the heaters A and B until the detection temperature reaches TT (S313). Then, when the detection temperature reaches TT, S38 is started to change to an image-forming-ready state and then S39 is started. In the case of this embodiment, S38, S39, S310 and S311 which are the flow from S38 downward is the same as S17, S18, S19 and S110 of an embodiment 1.

However, when TH is lower than 100° C. in S32, the time required until TH is raised by a predetermined temperature, that is, 20° C. in the case of this embodiment after start of the starting operation is confirmed in S33. That is, when the temperature rise time is short, even if the surface temperature of the heating roller is lowered, it is considered that the inside of the heating roller is sufficiently warm. Therefore, because of reaching up to the image-forming-ready temperature in a short time even if the heaters A and B are turned on for a long time, it is considered that an overshoot mount is small and start can be made in a short time. Thus, in the case of this embodiment, the temperature for forcibly turning off the heater A is changed in accordance with a temperature rise rate.

Thus, when the temperature rise rate of a heater is large in S33, S312 in the second starting mode is started by determining that only a short start time is required to pass through the same flow as described above. However, when the temperature rise rate for the case in which 30 sec or more is required in S33 is small, it is considered that the time when the heater A is turned on increases. Therefore, the time in which overshoot occurs is increased by lowering the temperature for forcibly turning off the heater A. Thus, until the detection temperature TH reaches T1 in S34 in the first starting mode, the heaters A and B are turned on. When the detection temperature TH reaches T1, the heater A is forcibly turned off (S36) to start S37. Thereafter, only the heater B is continuously heated until the detection temperature TH reaches TT. When the detection temperature TH reaches TT, S38 is started.

Thus, even if determination is made in accordance with not only the detection temperature but also the temperature rise rate, it is possible to further shorten the time before start is completed while preventing overshoot by using a configuration for forcibly stopping the power supply to the main heater in the middle of the starting operation when the temperature of the fixing rotational body is high.

Moreover, set temperatures and the predetermined time t of each embodiment are not restricted to values of the embodiment. There is no problem even if properly using other values.

Furthermore, in the case of each embodiment, a configuration using a halogen heater as an exothermic element is described. However, the present invention is not restricted to the configuration.

For example, there is no problem even if using the present invention for a configuration of an induction heating system in which a heating member generates heat in accordance with an eddy current generated in a dielectric layer of the heating member by a magnetic field by using a coil for generating the magnetic field.

Figure 8:
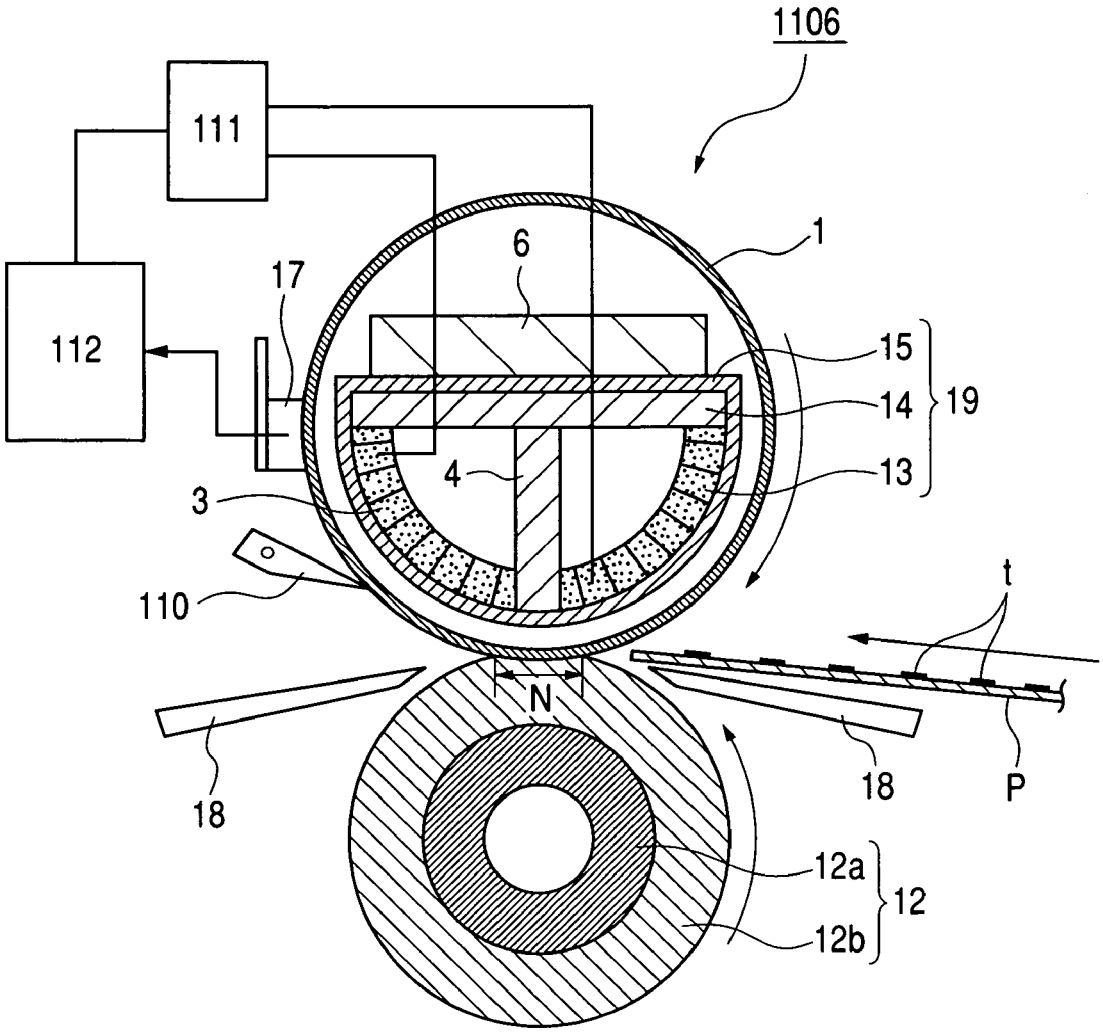
FIG. 8 is an illustration of a fixing apparatus using an induction heating system.

FIG. 8 is a cross sectional view of a heating-fixing apparatus 106 using a heating apparatus of the present invention as a heating source. The heating-fixing apparatus 106 of this example is a heat-roller-type apparatus for thermocompressing an unfixed toner image t on the surface of a recording material P by the heat of a fixing roller 1 and a nipping pressure at a fixing-nipping portion N by introducing the recording material P serving as a recording material bearing the unfixed toner image t into the nipping portion N serving as a pressure-contacting portion between a fixing roller as a heating member induction-heated and a pressure roller 12 serving as a pressuring member and nipping and conveying the recording material P.

A fixing roller, is a core bar cylinder having an outside diameter of 40 mm and a thickness of 0.7 mm and made of iron serving as a magnetic metallic member. It is allowed to form a layer made of fluorine resin such as PTFE or PFA and having a thickness of 10 to 50 μm on the surface of the core bar cylinder in order to improve the mold release characteristic.

The fixing roller 11 is rotatably supported with a bearing by setting the both ends of the fixing roller 11 to a fixing unit frame, which is rotated at a predetermined circumferential speed clockwise as shown by an arrow by a not-illustrated driving system.

The pressure roller 12 is constituted by a hollow core bar 12*a* and an elastic layer 12*b* which is a surface-mold-release-characteristic rubber layer formed on the outer periphery of the bar 12*a*. The pressure roller 12 is set under the fixing roller 11 in parallel with the fixing roller and the both ends of the hollow core bar 12*a* are rotatably supported by a not-illustrated fixing unit frame with a bearing, energized upward in the rotation-axis direction by a not-illustrated energizing mechanism using a spring or the like and pressed against the bottom of the fixing roller 11 at a predetermined pressure.

Because the pressure roller 2 pressure-contacts with the fixing roller 11, the elastic layer 12*b* is elastically deformed by the pressure-contacting portion with the fixing roller 11 and the fixing-nipping portion N having a predetermined width is formed as a heating portion of a material to be heated between the portion N and the fixing roller 11. In the case of this example, the pressure roller 12 is loaded at the total pressure of approx. 304N (approx. 30 kgw). In this case, the nipping width of the fixing-nipping portion N is approx. 6 mm. The pressure roller 12 is rotated by a pressure-contacting friction force at the fixing-nipping portion N in accordance with the rotation of the fixing roller 11. However, because the total pressure of them and the nipping width are only examples, there is no problem even if other values are used.

Symbol 19 denotes an induction coil assembly serving as magnetic-flux generating means which is covered with a covering member constituted by an induction coil 13, magnetic core 14 and coil holder 15. The induction coil 13 is covered with a covering member made of a heat-resistant material such as polyimide or polyamide-imide. The coil holder 15 is a member having a semicircular trough-shaped cross section made of a heat-resistant resin such as PPS, PEEK or phenol resin to form the induction coil assembly 19 in which the magnetic core 14 obtained by combining the induction coil 13 wound like a boat form with a flat ferrite having a thickness of 4 mm like a T-shape is housed. The outside of the coil holder 15 is set so as to face the inside of the fixing roller 11. Moreover, the induction coil 13 closely contacts with the coil holder 19.

The induction coil assembly 19 is inserted into the hollow portion of the fixing roller 11 while being held by a stay 16, the semicircular-arc side of the coil holder 15 is turned downward and the both ends of the stay 16 are fixed to a not-illustrated unit frame. The induction coil assembly 19 is set so that a gap is formed between the induction coil assembly 19 and the fixing roller 11.

Then, a heating operation is described below.

The fixing roller 11 is rotated, thereby the pressure roller 12 is rotated and an AC current of 10 to 100 kHz is applied to the induction coil 13 from an exciting circuit 111. A magnetic field induced by an AC current causes an eddy current to flow through the fixing roller 1 and generates Joule heat. That is, the fixing roller 1 is induction-heated.

The temperature of the fixing roller 11 is detected by a temperature sensor 17 such as a thermistor set so as to contact with the surface of the fixing roller and the detection temperature information (detection signal) is input to a control circuit 112. The control circuit 112 changes power supply from the exciting circuit 111 to the induction coil 13 in accordance with the input detection-temperature information so that the surface temperature of the fixing roller 11 becomes a predetermined constant temperature, that is, so that the temperature of the fixing-nipping portion N is automatically controlled to a predetermined fixing temperature.

Thus, the fixing roller 11 and pressure roller 12 are rotated, the fixing roller 1 is induction-heated and controlled to a predetermined temperature and under this state, the recording material P bearing the unfixed toner image t is guided by a conveying guide 8, introduced into the fixing-nipping portion N and nipped and conveyed and the unfixed toner image t is thermocompressed against the recording material P by the heat of the fixing roller 1 and a nipping pressure and fixed. The recording material P getting out of the fixing-nipping portion N is separated from the surface of the fixing roller 11 and discharged and conveyed. Symbol 110 denotes a recording material separating pawl set by contacting with or nearby the surface of the fixing roller 11 at the recording material exit of the fixing-nipping portion N.

In this case, a coil is constituted by a first coil in which the calorific value of the central portion of a heating member is larger than that of the end of it and a second coil in which the calorific value of the end of a heating member is larger than that of the central portion of it. In the case of the above configuration, the heater A of the above embodiment corresponds to the first coil and the heater B of it corresponds to the second coil. When a temperature for forcibly turning off the power supply to the first coil is set and the temperature of the heating member under the starting operation rises by using the above flowchart, a temperature for forcibly turning off the power supply to the first coil is further raised. According to the above configuration, also by applying the present invention to a heating apparatus using an induction heating system, it is possible to start the apparatus in a short time while preventing overshoot when the temperature of a fixing rotational body is high even in the case of a configuration for forcibly stopping the power supply to a main heater in the middle of the starting operation by using the present invention.

Thus, according to the present invention, it is possible to start the apparatus in a short time in the case of a configuration for forcibly stopping the power supply to a main heater in a short time in the middle of the starting operation while preventing overshoot when the temperature of a fixing rotational body is high.

Though embodiments of the present invention are described above, the present invention is not restricted to the embodiments. Any modification is allowed within the technical concept of the present invention.

What is claimed is:

1. An image forming apparatus comprising:

image forming means for forming an image on a recording material;

an image heating member for heating the image on the recording material;

heat applying means, provided within said image heating member, for applying heat to said image heating member, said heat applying means includes a first heating element having a heating ability at a central region larger than at an end region in width direction of said image heating member and a second heating element having a heating ability at the end region larger than at the central region in the direction;

detection means for detecting a temperature of said image heating member;

control means for controlling electric power supplied to said first and second heating elements to heat said image heating member up to a target temperature during a starting operation;

wherein when the detected temperature at a start of the starting operation is low, said control means stops supply of electric power to said first heating element when the detected temperature reaches a predetermined temperature lower than the target temperature and maintains supply of electric power to said second heating element; and wherein when the detected temperature at a start of the starting operation is high, said control means maintains supply of electric power to said first and second heating elements during the starting operation up to the target temperature.

2. An apparatus according to claim 1, wherein after the detected temperature reaches the target temperature, the supply of electric power to said first heating element is in an off state, and the supply of electric power to said second heating element is in an on state.

3. An apparatus according to claim 1, further comprising a notification means for notifying that it is possible to start an image formation when the detected temperature reaches the target temperature.

4. An image forming apparatus comprising:

image forming means for forming an image on a recording material;

an image heating member for heating the image on the recording material;

induction heating means provided within said image heating member, for induction heating said image heating member, wherein said induction heating means includes a first induction heating element having a induction heating ability at a central region larger than at an end region in a width direction of said image heating member and a second induction heating element having an induction heating ability at the end region larger than at the central region in the direction;

detection means for detecting a temperature of said image heating member;

control means for controlling electric power supplied to said first and second induction heating elements to heat said image heating member up to a target temperature during a starting operation;

wherein when the detected temperature at a start of the starting operation is low, said control means stops supply of electric power to said first induction heating element when the detected temperature reaches a predetermined temperature lower than the target temperature and maintains supply of electric power to said second induction heating element; and wherein when the detected temperature at a start of the starting operation is high, said control means maintains supply of electric power to said first and second induction heating elements during the starting operation up to the target temperature.

5. An apparatus according to claim 4, wherein after the detected temperature reaches the target temperature, the supply of electric power to said first induction heating element is in an off state, and the supply of electric power to said second induction heating element is in an on state.

6. An apparatus according to claim 4, further comprising a notification means for notifying that it is possible to start an image formation when the detected temperature reaches the target temperature.

* * * * *

UNITED STATES PATENT AND TRADEMARK OFFICE

CERTIFICATE OF CORRECTION

PATENT NO. : 7,130,554 B2
APPLICATION NO. : 10/792722
DATED : October 31, 2006
INVENTOR(S) : Koji Takematsu It is certified that error appears in the above-identified patent and that said Letters Patent is hereby corrected as shown below:

ON THE TITLE PAGE:
At Item (54), Title, "A" should be deleted.

ON THE TITLE PAGE:
At Item (56), References Cited, Foreign Patent Documents, "61-124581" should read --62-124581--.

ON THE TITLE PAGE:
At Item (57), Abstract, "fist" should read --first--.

COLUMN 1:
Line 1, "A" should be deleted.

COLUMN 3:
Line 11, "staring" should read --starting--.

COLUMN 4:
Line 53, "TT1" should read --T1--.

COLUMN 7:
Line 4, "trouble" should read --problem--.

COLUMN 8:
Line 59, "beared" should read --borne--.
Line 61, "bering" should read --bearing--.

COLUMN 12:
Line 7, "cross sectional" should read --cross-sectional--.

COLUMN 14:
Line 32, "low," should read --lower than a predetermined temperature,--.
Line 34, "predetermined" should be deleted.
Line 35, "temperature" should read --temperature which is--.
Line 36, "maintains" should read --is higher than the predetermined temperature and maintains--.
Line 37, "element;" should read --element during the starting operation up to the target temperature;--.
Line 39, "high," should read --higher than the predetermined temperature,--.
Line 60, "a" (second occurrence) should read --an--.

UNITED STATES PATENT AND TRADEMARK OFFICE

CERTIFICATE OF CORRECTION

PATENT NO. : 7,130,554 B2
APPLICATION NO. : 10/792722
DATED : October 31, 2006
INVENTOR(S) : Koji Takematsu It is certified that error appears in the above-identified patent and that said Letters Patent is hereby corrected as shown below:

COLUMN 15:
Line 6, “low,” should read --lower than a predetermined temperature,--.
Line 8, “pre-” should be deleted.
Line 9, “determined temperature” should read --temperature which is--.
Line 10, “ture” should read --ture and is higher than the predetermined temperature--.
Line 11, element;” should read --element during the starting operation up to the target temperature;--.
Line 13, “high,” should read --higher than the predetermined temperature--.

Signed and Sealed this

Seventh Day of August, 2007

JON W. DUDAS
*Director of the United States Patent and Trademark Office*